US007766206B2

(12) United States Patent
Kurth et al.

(10) Patent No.: US 7,766,206 B2
(45) Date of Patent: Aug. 3, 2010

(54) HAND-HELD SETTING TOOL

(75) Inventors: Emanuel Kurth, Malans (CH); Urs Mueller, Schiers (CH); Marc Putzi, Pragg-Jenaz (CH); Tilo Dittrich, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 12/009,554

(22) Filed: Jan. 17, 2008

(65) Prior Publication Data

US 2008/0179372 A1 Jul. 31, 2008

(30) Foreign Application Priority Data

Jan. 19, 2007 (DE) ..... 10 2007 000 025

(51) Int. Cl.
*B25C 1/04* (2006.01)

(52) U.S. Cl. ..... 227/119; 227/120; 227/136; 227/138

(58) Field of Classification Search ..... 227/109, 227/120, 136, 138, 137, 119
See application file for complete search history.

(56) References Cited

U.S. PATENT DOCUMENTS 1,463,890 A * 8/1923 Hohn ..... 227/138
1,542,340 A * 6/1925 Crofoot ..... 227/138
1,582,223 A * 4/1926 Polzer ..... 227/96
3,009,156 A * 11/1961 Lerner ..... 227/88
3,108,368 A * 10/1963 Steward ..... 29/432
3,154,234 A * 10/1964 Cootes ..... 226/64
3,961,408 A * 6/1976 Goodsmith et al. ..... 29/706
4,463,888 A * 8/1984 Geist et al. ..... 227/109
4,942,996 A * 7/1990 Wolfberg et al. ..... 227/136
5,240,161 A * 8/1993 Kaneko ..... 227/109
5,339,983 A * 8/1994 Caple ..... 221/25
5,772,098 A * 6/1998 Crutcher ..... 227/119
5,799,856 A * 9/1998 Mukoyama ..... 112/112
6,050,471 A * 4/2000 Yagi ..... 227/119
6,170,730 B1 * 1/2001 Lin ..... 227/119
6,308,880 B1 * 10/2001 Ronconi ..... 227/119
6,688,510 B2 * 2/2004 Amada ..... 227/119
6,968,945 B2 * 11/2005 Bruins et al. ..... 206/338
7,021,511 B2 * 4/2006 Popovich et al. ..... 227/8
7,225,962 B2 * 6/2007 Porth et al. ..... 227/136

* cited by examiner

*Primary Examiner*—Scott A. Smith
(74) *Attorney, Agent, or Firm*—Abelman, Frayne & Schwab

(57) ABSTRACT

A hand-held setting tool for driving fastening elements in a workpiece includes a drive-in ram (12) displaceable in the guide (15) in which a receptacle (16) for the fastening elements (23) is located and which has a feeding opening (17) for the fastening elements (23) and located in a region of the receptacle (16), and a displacement device (30) for displacing the fastening elements (23) into the receptacle (16) and controlled by the drive-in ram (12).

11 Claims, 3 Drawing Sheets

HAND-HELD SETTING TOOL

BACKGROUND OF THE INVENTION

1. Field of the Invention

The present invention relates to a hand-held setting tool for driving fastening elements in a workpiece and includes a guide, a drive-in ram displaceable in the guide, a receptacle for the fastening elements located in the guide that has a feeding opening for the fastening elements and located in a region of the receptacle, and a displacement device for displacing the fastening elements into the receptacle.

2. Description of the Prior Art

Setting tools of the type described above are used for driving fastening elements stored in a fastening element magazine, such as nails, bolts, pins, etc. in concrete, steel, wood, and so on. The setting tools can be driven with fluid, gaseous or solid fuels or by pneumatic, mechanical or electro-pneumatic drives.

U.S. Pat. No. 4,942,996 discloses a setting tool for driving fastening elements in and including a housing that includes a nose part having a guide for a nail. A magazine, which is arranged on the setting tool, stores the nails which are collated on a carrier strip. A feeding channel connects the magazine with the guide provided in the nose part of the housing, so that a nail can be displaced into the guide by a displacement device. The displacement device has a transporting pawl arranged sidewise on the feeding channel and engageable with the carrier strip for displacing same in the transportation direction. A compression spring biases the pawl into its extended position in which it engages the carrier strip, and a pneumatic mechanism displaces the pawl to its retracted position in which the pawl is disengaged from the strip.

A drawback of the above-described setting tool consists in the complicated structure of the displacement device and associated high manufacturing costs.

Another drawback of the above-described setting tool consists in that additional space is needed in the region of the magazine for the displacement device.

Accordingly, an object of the present invention is to provide a setting tool in which the drawbacks of the known setting tool are eliminated.

Another object of the present invention is to provide a setting tool in which displacement of the fastening elements can be effected automatically in a simple manner.

SUMMARY OF THE INVENTION

These and other objects of the present invention, which will become apparent hereinafter, are achieved by providing a setting tool in which the displacement device is directly controlled by the drive-in ram.

The direct control of the displacement device by the drive-in ram permits to eliminate additional devices and elements for actuation of the displacement device. E.g., a pneumatic actuation device for the pawl is eliminated. In addition, the elimination of the additional pawl-actuating devices and/or elements permits to reduce the required constructional space, and reduces manufacturing costs.

Advantageously, the displacement device has at least one transportation member for transporting the fastening elements, spring means for biasing the at least one transportation member in a direction toward the guide, and a control member that cooperates with the drive-in ram. The control member converts, in a simple manner, the displacement of the drive-in ram in the setting direction into displacement of the transportation member which is spring-biased in the transportation direction and which, after return of the drive-in ram to its setting-ready initial position, transports the fastening element strip or collated thereon, fastening elements in the direction of the guide in order to advance another fastening element.

According to an advantageous embodiment of the invention, the free end of the control member projects into the guide. The control member which, advantageously, is formed as a pivot member, is pivoted away by the drive-in ram movable in the setting direction during a setting process, and also serves as a retainer that retains the drive-in ram in its initial position.

Advantageously, the free-end of the control member has an inclination run-off surface for the drive-in ram. Thereby, a speed reduction and a resulting lower stress of respective tool components is achieved. Simultaneously, the drive-in ram can be secured in its initial position with a smaller holding force.

Advantageously, the transportation member and the control member are pivotally supported on a support axle extending transverse to a driving axis defined by the drive-in ram, with the transportation member, and the control member being movement-coupled. The transportation member and the control member can be formed integrally with each other as a one-piece member. Thereby, both smaller tolerance sensitivity and cost-effective manufacturing are achieved.

Advantageously, the transportation member has, at its end remote from the support axle, a driving element for engaging transportation openings of a fastening element strip for displacing same.

With the provision of the driving member at the end of the end transportation member, a smaller pivot angle of a pivotal movement of the transportation member, at a corresponding length of the transportation member, provides for an adequate displacement path of the fastening element strip.

Advantageously, the transportation member-biasing spring means is formed as a torsion spring for elastically biasing the transportation member in a direction toward the guide and supported on the support axle. The use of a torsion spring as the transportation member-biasing spring means permits to further reduce the volume of space for the displacement device as no additional space for the biasing spring means is needed. Further, the accelerated mass is reduced, which provides for a simple adjustment of the preload. Also, the spring has a more flat spring characteristic.

It is further advantageous when the transportation member is flexural in a direction of its longitudinal extent and transverse to a plane defined by the driving axis and a fastening element magazine that projects sidewise form the guide. As a result, the transportation member is pivoted sidewise of the fastening element strip, being displaceable therealong, in the direction opposite the transportation or displacement direction of the strip, when the transportation member is pivoted by the drive-in ram. The pivotal movement of the transportation member is facilitated by provision, on the driving member, an inclination surface that is inclined in the direction opposite the transportation direction.

It is advantageous when the displacement device is supported on the guide of the setting tool, so that with systems with replaceable fastening element strip, each displacement device needs not to be provided on each of the replaceable fastening element strips.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
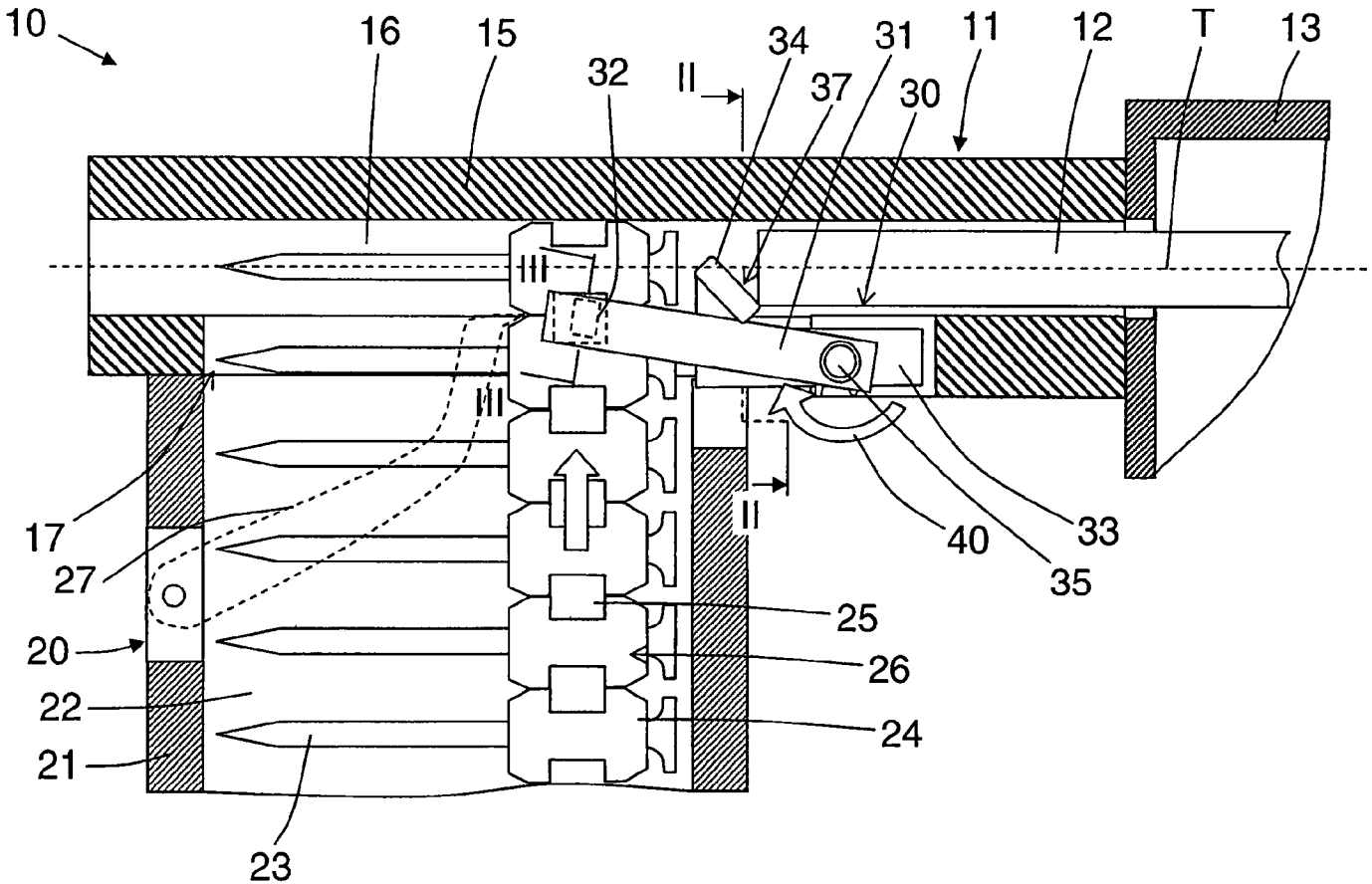
FIG. 1 a side cross-sectional view of a muzzle part of a hand-held setting tool according to the present invention together with a magazine for fastening elements.

A hand-held setting tool 10 according to the present invention, a muzzle part 11 of which is shown in FIG. 1, includes a housing 13 and a setting mechanism located in the housing 12 and having a drive-in ram 12. The setting mechanism can be actuated with an actuation switch, not shown, when the setting tool 10 is pressed with its muzzle part 11 against a workpiece. Different embodiments of the setting mechanism are known and which can be driven electrically, pneumatically, or by combustion power. The drive-in ram 12 defines a driving axis T along which the drive-in ram 12 is displaced in a guide 15.

The guide 15 forms part of the muzzle part 11 and is formed as a guide tube in which a receptacle 16 for a fastening element 23 is provided. A magazine 20 for fastening elements 23, which is releasably secured to the guide 15, projects sidewise therefrom. The magazine 20 has a magazine housing 21 and guide channel 22 provided in the magazine housing 21 for the fastening elements 23. The guide 15 has a feeding opening 17 through which the guide channel 22 communicates with the receptacle 16 in the guide 15. A strip 24 with the fastening elements 23 is displaced in the guide channel 22. Support elements 26 retain the fastening elements 23 on the strip 24. The strip 24 is also provided with transportation openings 25.

Figure 3:
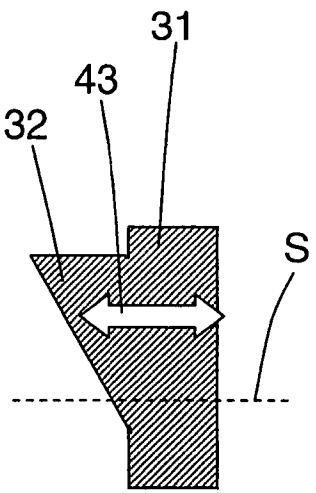
FIG. 3 a cross-sectional view along line III-III in FIG. 1.
Figure 2:
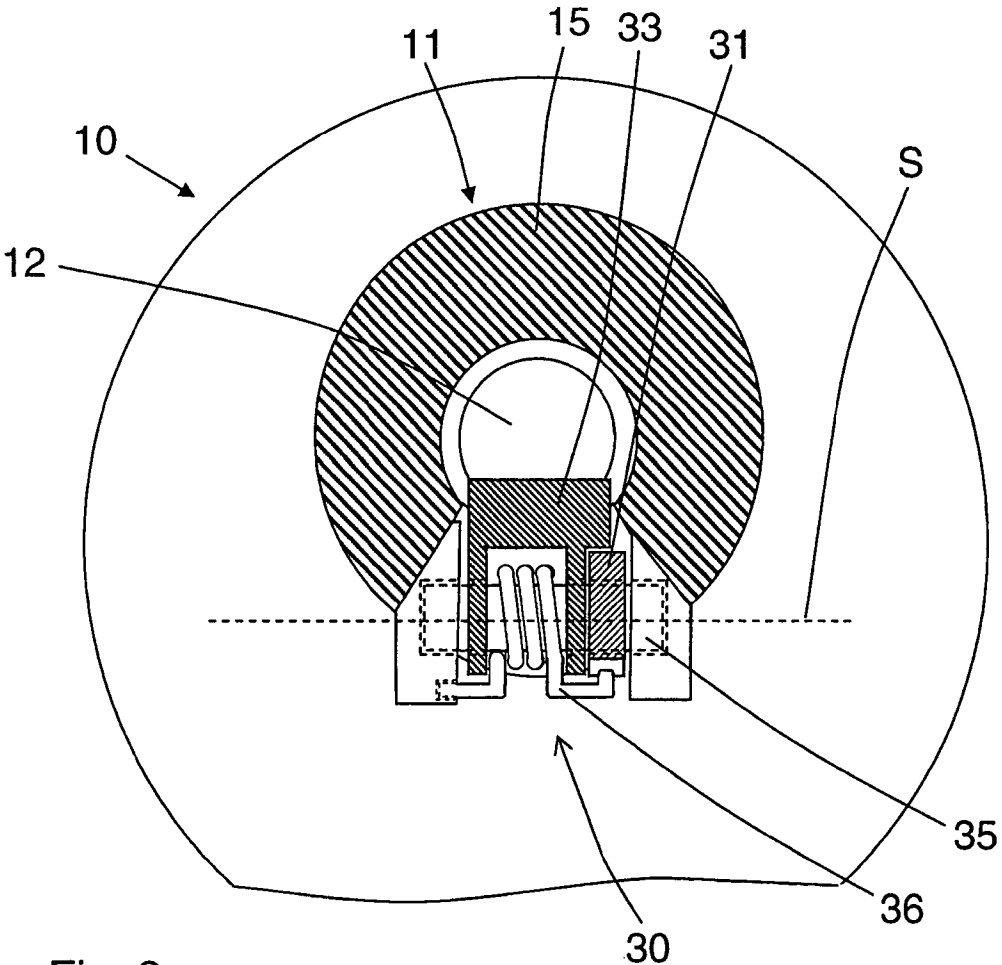
FIG. 2 a cross-sectional view along line II-II in FIG. 1.

The muzzle part 11 is further provided with a displacement device, which is generally designated with a reference numeral 30, for displacing the strip 24, together with the fastening elements 23. The displacement device 30 has a control member 33 pivotally supported on an axle 35, and a transportation member 31 likewise pivotally supported on the axle 35. The transportation member 31 is biased in a direction toward the guide 15 or in the transportation direction by a torsion spring 36 (see in particular FIG. 2). The support axle 35, which defines the pivot axis S extends transverse to a plane in which the driving axis T and the fastening element magazine 20 are arranged. As particularly shown in FIG. 3 in combination with FIG. 1 or 4, the transportation member 31 is flexural in the direction of its longitudinal extent and transverse to the plane defined by the driving axis T and the magazine 20 (double arrow 43 in FIG. 3) and has, at its free end remote from the support axle 35, a driving element 32. The driving element 32 has an inclination surface that extends in a direction opposite the transportation direction and that can engage a transportation opening 25 of the strip 24. In order to achieve a desired flexibility, the transportation member 31 can be formed, e.g., of a spring sheet metal.

The transportation member 31 and the control member 33 are movement-coupled, and the control member 33 projects in the initial position of the setting tool 10 and of the drive-in ram 12, which is shown in FIG. 1, with its free-end 34 into the guide 15, with the free end 34 of the control member 33 retaining the drive-in ram 12 in its initial position. At the free end 34 of the control member 33, there is provided a run-off surface 37 for a setting direction end of the drive-in ram 12, so that the control member 33 can be displaced form the drive-in ram 12 with a small energy loss.

Figure 4:
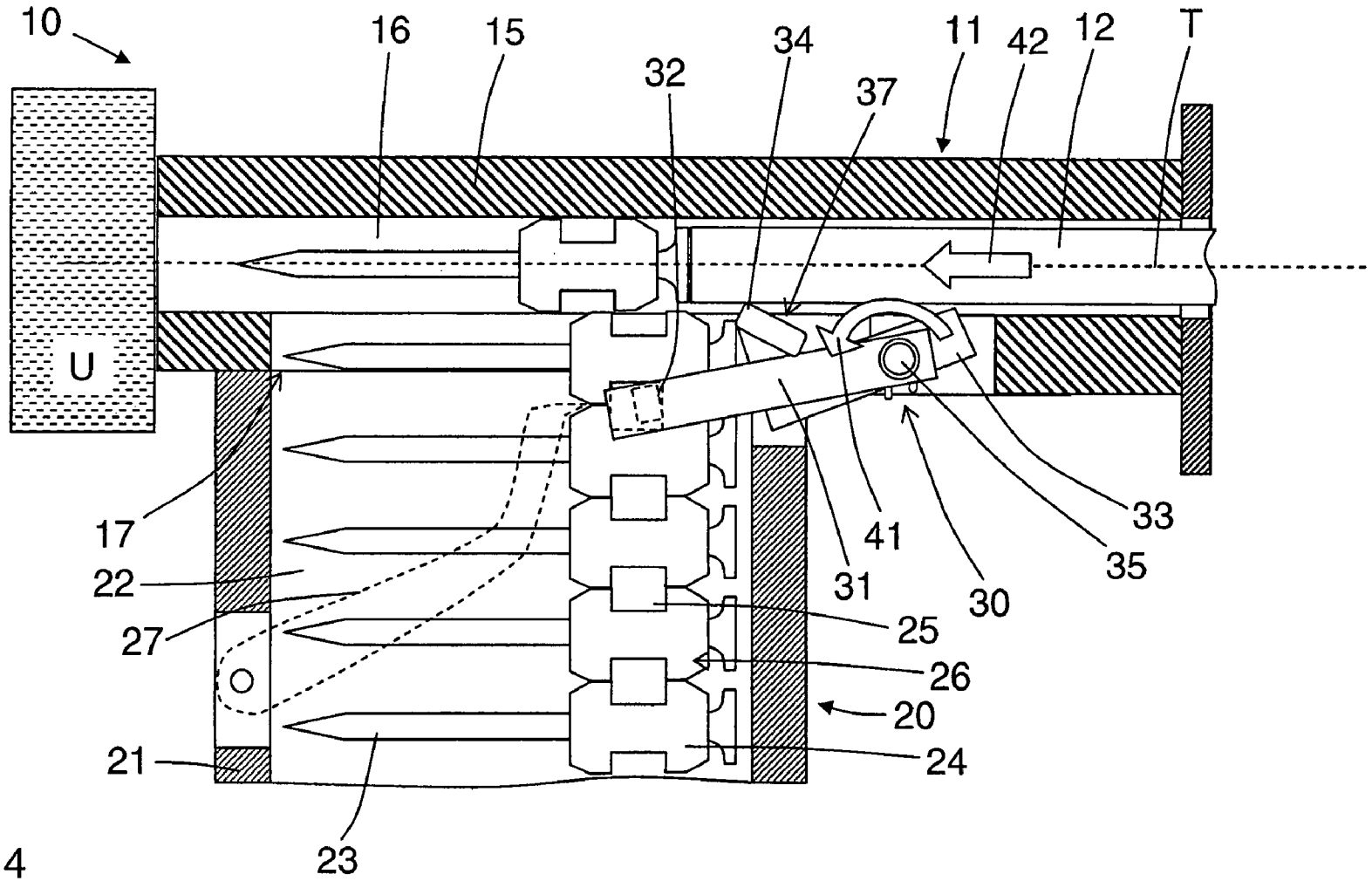
FIG. 4 a side cross-sectional view of the muzzle part of the setting tool shown in FIG. 1 during a setting process.

When the setting tool 10 is pressed against the workpiece U, as shown in FIG. 4, and is actuated with the actuation switch (not shown), the drive-in ram 12 or a setting piston is displaced along the driving axis T in the setting direction 42, driving the fastening element 23 located in the guide 15. An end of the drive-in ram 12 adjacent to the fastening element 23 passes past the inclined run-off surface 37 of the control member 33, pivoting the control member 33 in the direction of the second arrow 41 about the support axle 35. With the control member 33, the transportation member 31 also pivots in the direction of the second arrow 41. Thereby, the transportation member 31 can, due to its flexural elasticity and to the inclination surface on the driving element 32, be displaced over the fastening element strip 24, until the driving element 32 engages the next transportation opening 25 of the fastening element strip 24. As shown in FIGS. 1 and 4, a safety element 27, shown in FIGS. 1 and 4 only with dash lines and formed as a pivotal pawl, is also provided for the fastening element strip 24. The safety element 27 prevents only displacement of the fastening element strip 24, in the direction opposite the transportation direction (from the receptacle 16), when the driving element 32 is displaced in the direction opposite the transportation direction.

After completion of the setting process, when the drive-in ram 12 is returned to its initial position, which is shown in FIG. 1, the transportation member 31 is pivoted by the torsion spring 36 in the direction of the first arrow 40, displacing the driving element 32 for the fastening element strip 24 and, thereby, the fastening element strip 24, whereby a new fastening element 23 is displaced into the receptacle 16 in the guide 15. Simultaneously, the control member 33 is displaced, together with the transportation member 31, pivoting into the position in which its free end with the inclined run-off surface 37 projects into the guide 15.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A power driven hand-held setting tool for driving fastening elements in a workpiece, comprising:

a guide (15);

a drive-in ram (12) displaceable in the guide (15);

a power driven setting mechanism for displacing the drive-in ram (12);

a receptacle (16) for the fastening elements (23) and located in the guide (15), the guide (15) having a feeding opening (17) for the fastening elements (23) and located in a region of the receptacle (16); and a displacement device (30) for displacing the fastening elements (23) into the receptacle (16) and controlled by the drive-in ram (12), the displacement device (30) having at least one pivotally supported transportation member (31) for transporting the fastening elements and pivotable from a first position thereof in which the transportation member (31) blocks transportation of a fastening element (23) into the receptacle (16) to a second position thereof for advancing the fastening element in the receptacle (16).

2. A hand-held setting tool according to claim 1, wherein the displacement device (30) is arranged on the guide (15).

3. A hand-held setting tool according to claim 1, further comprising a control member (33) that cooperates with the drive-in ram (12) for pivoting the transportation member (31) to the first position thereof in response to displacement of the drive-in ram (12) in an operational position thereof.

4. A hand-held setting tool according to claim 3, wherein the control member (33) has a free end (34) projecting into the guide (15).

5. A hand-held setting tool according to claim 4, wherein the free end (34) of the control member (33) has an inclination run-off surface (37) for a setting direction end of the drive-in ram (12).

6. A hand-held setting tool according to claim 3, wherein the transportation member (31) and the control member (33) are pivotally supported on a support axle (35) extending transverse to a driving axis (T) defined by the drive-in ram (12), the transportation member (31) being coupled with the control member (31).

7. A hand-held setting tool according to claim 6, wherein the transportation member (31) has, at an end thereof remote from the support axle (35), a driving element (32) for engaging transportation means (25) of a fastening element strip (24) for displacing the fastening element strip.

8. A hand-held setting tool according to claim 3, wherein the spring means (36) comprises a torsion spring for elastically biasing at least the transportation member (31) in a direction toward the guide (15) and supported on a support axle (35).

9. A hand-held setting tool according to claim 3, wherein the at least one transportation member (31) is flexible in a direction of its longitudinal extent thereof and transverse to a plane defined by the driving axis (T) and a fastening element magazine (20) that projects sidewise from the guide (15).

10. A hand-held setting tool according to claim 3, further comprising spring means (36) for biasing the at least one transportation member (31) in a direction toward the guide and for pivoting the transportation member (31) from the first position thereof to the second position thereof when the drive-in ram (12) is displaced in an initial position thereof.

11. A hand-held setting tool according to claim 3, wherein the control member (33) and the transportation member (31) are movement-coupled, the drive-in ram (12) engaging upon being displaced in the operational position thereof, the control member (33) for displacing same and, thereby, for pivoting the transportation member (31) from the first position to the second position.

* * * * *